US006379572B1

(12) United States Patent
Kikuchi et al.

(10) Patent No.: US 6,379,572 B1
(45) Date of Patent: Apr. 30, 2002

(54) FLAT PANEL DISPLAY WITH SPACED APART GATE EMITTER OPENINGS

(75) Inventors: Kazuo Kikuchi, Sunnyvale, CA (US); Shinji Kubota, Sugamihara (JP)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 140 days.

(21) Appl. No.: 09/585,984

(22) Filed: Jun. 2, 2000

(51) Int. Cl.[7] ..... H01J 9/00

(52) U.S. Cl. ..... 216/42; 216/11; 216/17; 216/47; 216/24; 445/24; 445/50

(58) Field of Search ..... 216/11, 17, 24, 216/42, 47; 430/311; 445/24, 50; 438/947, 950

(56) References Cited

U.S. PATENT DOCUMENTS

| | | | | |
|---|---|---|---|---|
| 5,669,800 A | | 9/1997 | Ida et al. | 445/25 |
| 5,700,627 A | | 12/1997 | Ida et al. | 430/311 |
| 5,817,373 A | * | 10/1998 | Cathy et al. | 427/458 |
| 5,865,659 A | | 2/1999 | Ludwig et al. | 445/50 |
| 6,080,325 A | * | 6/2000 | Cathy et al. | 216/11 |
| 6,083,767 A | * | 7/2000 | Tjaden et al. | 438/20 |

OTHER PUBLICATIONS

M. Ida, B. Montmayeul, and R. Meyer, "New Microlithography Technique for Large Size Field Emission Displays", LETI–CEA, Grenoble, France, Oct. 1996.

* cited by examiner

*Primary Examiner*—Randy Gulakowski
*Assistant Examiner*—Shamin Ahmed
(74) *Attorney, Agent, or Firm*—Mikio Ishimaru

(57) ABSTRACT

A method is provided for manufacturing a flat panel display in which a baseplate has a conductive row electrode deposited on it followed by an insulator. A conductive gate electrode is deposited over the insulator and a soft mask material is deposited over the conductive gate electrode. Microspheres are deposited on the soft mask material and an isotropic etch uses the microspheres as a mask to etch the soft mask material to form soft mask portions under the microspheres. The microspheres are removed and a hard mask material is deposited over the soft mask portions. The hard mask material is processed and chemical mechanical polished down to the soft mask portions which are removed by etching to leave a hard mask which is used by anisotropic etch process to form gate holes in the gate electrode. The gate holes are used to form emitter cavities into which emitters are deposited.

20 Claims, 3 Drawing Sheets

FLAT PANEL DISPLAY WITH SPACED APART GATE EMITTER OPENINGS

TECHNICAL FIELD

The present invention relates generally to flat panel displays and more particularly to flat panel displays with spaced apart gate holes.

BACKGROUND ART

The cathode-ray tube (CRT) displays have been the predominant display technology for purposes such as home television and computer systems. For many applications, CRTs have advantages in terms of superior color resolution, high contrast and brightness, wide viewing angles, fast response times, and low manufacturing costs. However, CRTs also have major drawbacks such as excessive bulk and weight, fragility, high power and voltage requirements, strong electromagnetic emissions, the need for implosion and x-ray protection, undesirable analog device characteristics, and a requirement for an unsupported vacuum envelope that limits screen size.

To address the inherent drawbacks of CRTs, alternative display technologies have been developed. These technologies generally provide flat panel displays, and include liquid crystal displays (LCDs), both passive and active matrix, electroluminescent displays (ELDs), plasma display panels (PDPs), vacuum fluorescent displays (VFDs) and field emission displays (FEDs).

The FED offers great promise as an alternative flat panel display technology. Its advantages include low cost of manufacturing as well as the superior optical characteristics generally associated with the CRT display technology. Like CRTs, FEDs are phosphor based and rely on cathodoluminescence as a principle of operation. FEDs rely on electric field or voltage induced emissions to excite the phosphors by electron bombardment rather than the temperature induced emissions used in CRTs. To produce these emissions, FEDs have generally used row-and-column addressable cold cathode emitters of which there are a variety of designs, such as point emitters (also called cone, microtip, or "Spindt" emitters), wedge emitters, thin film amorphic diamond emitters, and thin film edge emitters.

Each of the FED emitters is typically a miniature electron gun of micron dimensions. A row electrode deposited on a baseplate acts as a cathode and a transparent electrode on a transparent faceplate acts as an anode. An insulator and a resistor separate the row electrode from a column electrode and the column electrode is connected to a gate electrode.

A "gate hole" is formed in the gate electrode and an emitter cavity is formed through the gate hole into the insulator down to the resistor. The gate hole is used as the pattern to deposit the emitter in the emitter cavity so that the tip of the emitter is adjacent the gate electrode.

When a sufficient voltage is applied between the emitter, coupled by the resistor to the row electrode, and an adjacent gate electrode, electrons are emitted from the emitter into a vacuum, which is located between a baseplate, upon which the emitters are mounted, and a faceplate having a transparent anode surface to which the phosphors are applied. The emitted electrons are attracted and accelerated to strike the phosphors on the faceplate. The phosphors then emit visible light which form picture elements, or pixels, which make up the images on the face of the FED.

One of the major problems with the FED is in the manufacture of the gate and the gate holes. As the size of the FED panels increase in size, it is necessary to decrease the diameters of the gate holes in order to reduce the driving voltage for the emitters which are driven by charges on the gate. To do this, various techniques have been developed including one of using microspheres as masks for the etching of the gate holes.

The microspheres are deposited on the gate, an etch resistant material is deposited on the microspheres and the gate, the microspheres with the etch resistant material are removed leaving the negative pattern of the etch resistant material on the gate, and the gate holes are etched in the gate where it is free from the etch resistant material.

The difficulty with this technique is that the microspheres randomly stick together and form sets of gate holes which run into each other, referred to a "doublets", and which prevent the proper formation of the emitters.

This is a major problem facing FEDs manufactured by this process, but no satisfactory solution has heretofore been discovered.

DISCLOSURE OF THE INVENTION

The present invention provides a method for manufacturing a flat panel in which a soft mask material is deposited over the flat panel. Microspheres are deposited on the soft mask material and an isotropic etch uses the microspheres as a mask to etch the soft mask material to form soft mask portions under the microspheres. The microspheres are removed and a hard mask material is deposited over the soft mask portions. The hard mask material is processed and chemical mechanical polished down to the soft mask portions which are removed by etching to leave a hard mask which is used in an ansotropic etching process to form holes in the flat panel. The holes are spaced apart with no doubling and smaller holes are possible than with the prior art.

The present invention provides a method for manufacturing a flat panel display in which a baseplate has a conductive row electrode deposited on it followed by an insulator. A conductive gate electrode is deposited over the insulator and a soft mask material is deposited over the conductive gate electrode. Microspheres are deposited on the soft mask material and an isotropic etch uses the microspheres as a mask to etch the soft mask material to form soft mask portions under the microspheres. The microspheres are removed and a hard mask material is deposited over the soft mask portions. The hard mask material is processed and chemical mechanical polished down to the soft mask portions which are removed by etching to leave a hard mask which is used by anisotropic etch process to form gate holes in the gate electrode. The gate holes are used to form emitter cavities into which emitters are deposited. The gate holes are spaced apart with no doubling and smaller gate holes are possible than with the prior art.

The above and additional advantages of the present invention will become apparent to those skilled in the art from a reading of the following detailed description when taken in conjunction with the accompanying drawings.

BEST MODE FOR CARRYING OUT THE INVENTION

Figure 1:
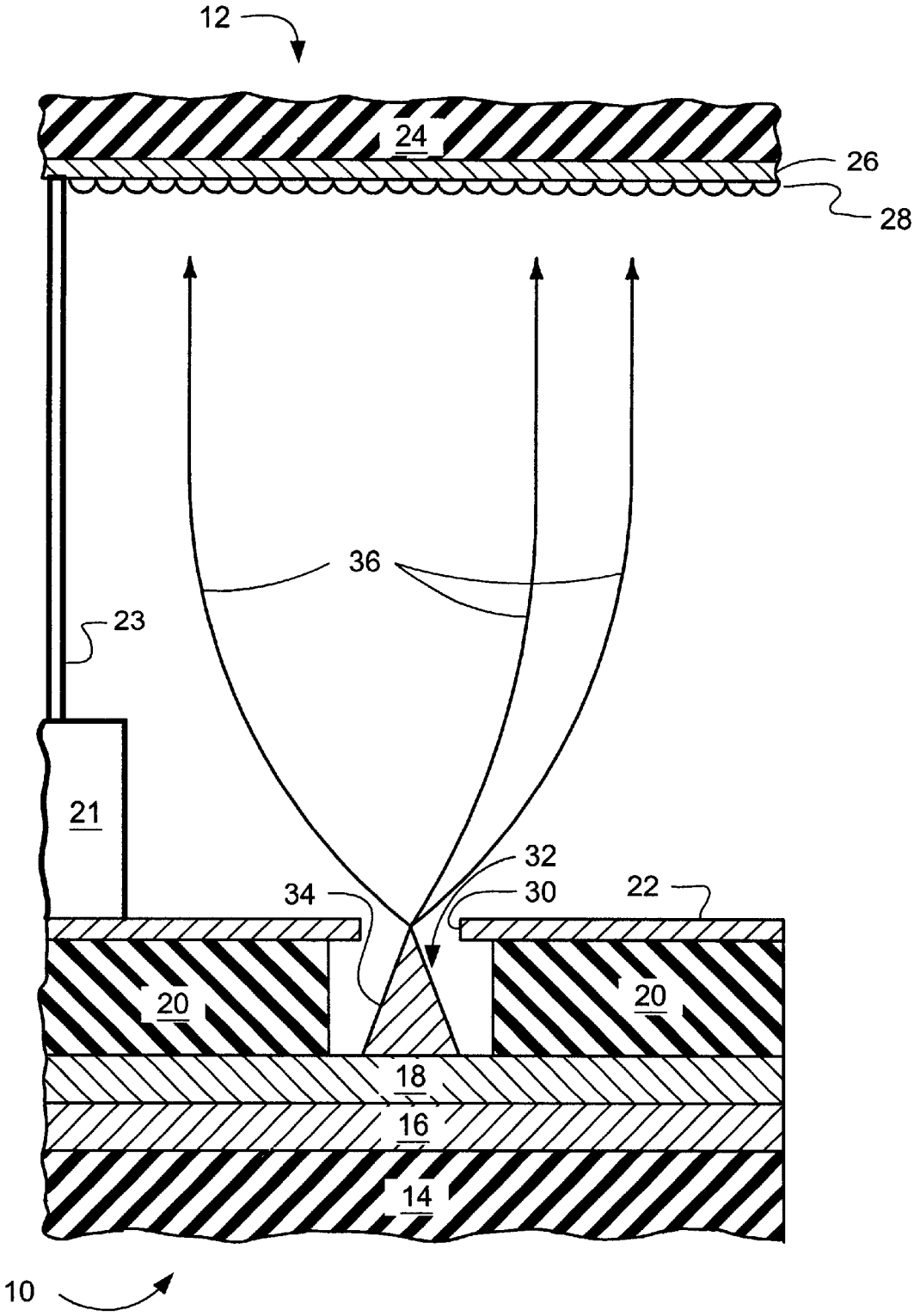
FIG. 1 (PRIOR ART)
FIG. 1 (PRIOR ART) is a close up cross-sectional view of a field emission display for a single picture element.

Referring now to FIG. 1 (PRIOR ART), therein is shown an isometric section of a portion of a flat panel display 10 for a single pixel 12. The structure of the flat panel display 10 includes a baseplate 14. The baseplate 14 is composed of a non-conductive material, such as glass or plastic.

A conductive row electrode 16 is deposited on the baseplate 14, which is one of a multiplicity of parallel conductive row electrodes on the baseplate 14. A resistive layer 18 is deposited over the conductive row electrode 16. An insulator 20, or interlayer dielectric (ILD), is deposited over the resistive layer 18. A conductive gate electrode 22 is deposited over the insulator 20 and formed as a flat, thin structure.

Spaced a short distance away from the conductive gate electrode 22 by a focus plate 21 and a sidewall 23 is a transparent faceplate 24 with a transparent electrode 26 deposited on the side closest to the conductive gate electrode 22. The transparent electrode 26 has phosphors 28 deposited on the surface adjacent the conductive gate electrode 22. The baseplate 14 and the transparent faceplate 24 contain a vacuum in-between.

As will subsequently be described in greater detail, the conductive gate electrode 22 has a plurality of through-openings provided therein, of which an opening 30 is typical. A plurality of emitter cavities, of which the emitter cavity 32 is typical, is positioned coaxially with each opening 30. An emitter 34 is formed in each cavity 30 in electrical contact with the resistive layer 18. In operation, the emitter 34 emits electrons which are directed into parabolic paths 36 by the focus plate 21 to strike the phosphors 28 which emit light as the pixel 12.

The conductive row electrode 16 is of a conductive material such as aluminum (Al) or nickel (Ni), with a protective cladding (not shown) of a material such as tantalum (Ta) or titanium (Ti). The conductive row electrode 16 is one of a plurality of parallel electrodes.

The resistive layer 18 is composed of a material, such as silicon carbide (SiC) or silicon cyanide (SiCN), with a ceramic-metal (cermet) cladding of a material which is a mixture of chromium in silicon dioxide (Cr—$SiO_2$). The resistive layer 18 acts as a ballast to provide for uniformity of electron emission from the emitter 34 in addition to providing other ancillary features during manufacture and operation such as acting as an etch stop for the emitter cavity 32 and providing short-circuit protection between the conductive row electrode 16 and the emitter 34.

The insulator 20 is a conventional semiconductor interlayer dielectric (ILD) material, such as silicon dioxide ($SiO_2$), which provides the insulation between the conductive row electrode 16 and conductive column electrode (not shown) which are connected to the conductive gate electrode 22. The insulator 20 further acts as an insulator between the resistive layer 18 and the conductive gate electrode 22 at the emitter 34 as shown in FIG. 1 (PRIOR ART). The conductive column electrode (not shown) is one of a plurality of parallel strips, composed of material such as Ni or Al, running perpendicular to the conductive rows represented by the conductive row electrode 16.

The conductive gate electrode 22 is made of a fairly dense metal, such as chromium (Cr), which is resistant to electron impact.

The faceplate 24 is composed of a transparent, non-conductive material, such as glass or plastic, with a transparent conductive coating, of materials such as indium tin oxide or thin gold.

Figure 2A:
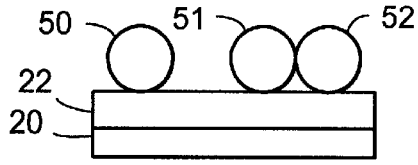
FIG. 2A (PRIOR ART)
FIGS. 2A & 2B (PRIOR ART) are a cross-sectional side view and a top view of a gate with deposited microspheres.
Figure 2B:
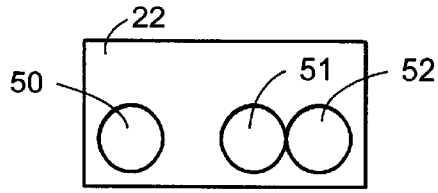
FIG. 2B (PRIOR ART)

Referring now to FIGS. 2A & 2B (PRIOR ART), therein are respectively shown a cross-sectional side view and a top view of the insulator 20 having the conductive gate electrode 22 deposited on top. After cleaning, uniformly-sized particles, such as microspheres 50–52, are deposited randomly on the conductive gate electrode 22. The microspheres 50–52 may be of a number of different types of material, such as plastic, silica, or glass.

Despite the random distribution, certain of the microspheres 51 and 52 will engage and remain in contact throughout subsequent steps.

Figure 3A:
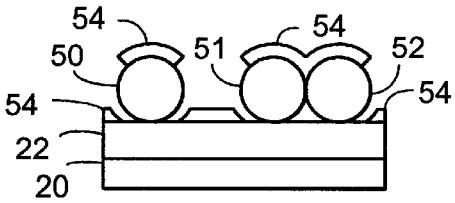
FIG. 3A (PRIOR ART)
FIGS. 3A & 3B (PRIOR ART) are a cross-sectional side view and a top view after metal deposition.
Figure 3B:
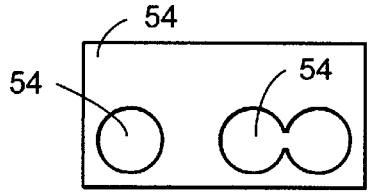
FIG. 3B (PRIOR ART)

Referring now to FIGS. 3A & 3B (PRIOR ART), therein are shown a cross-sectional side view and a top view of the structure of respective FIGS. 2A & 2B (PRIOR ART) after a deposition of an etch resistant material 54 vertically onto the microspheres 50–52 and the surface of the conductive gate electrode 22. The etch resistant material 54 would be an anisotropically deposited material such as aluminum (Al) deposited by evaporation.

It will be noted that the etch resistant material 54 will form a single coating over the microspheres 51 and 52.

Figure 4A:
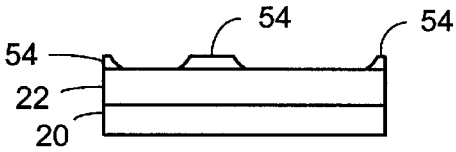
FIG. 4A (PRIOR ART)
FIGS. 4A & 4B (PRIOR ART) are a cross-sectional side view and a top view after removal of the microspheres.
Figure 4B:
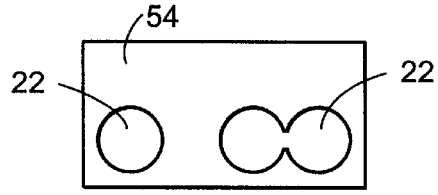
FIG. 4B (PRIOR ART)

Referring now to FIGS. 4A & 4B (PRIOR ART), therein are shown a cross-sectional side view and a top view of the structure of FIGS. 3A & 3B (PRIOR ART) after a microsphere removal process. This removal process is performed by a megasonic cleaning process which removes the microspheres 50–52 and the etch resistant material 54 shown in FIGS. 3A & 3B (PRIOR ART). This removal process exposes the conductive gate electrode 22 through the etch resistant material 54.

Figure 5A:
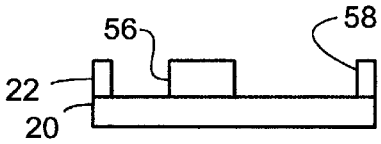
FIG. 5A (PRIOR ART)
FIGS. 5A & 5B (PRIOR ART) are a cross-sectional side view and a top view after gate etch.
Figure 5B:
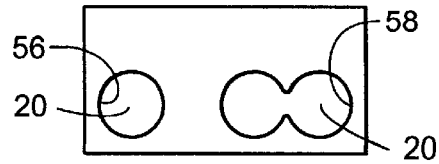
FIG. 5B (PRIOR ART)

Referring now to FIGS. 5A & 5B (PRIOR ART), therein are shown a cross-sectional side view and a top view of the structure of FIGS. 4A & 4B (PRIOR ART) after etch of the conductive gate electrode 22 and removal of the etch resistant material 54 to form a gate hole 56 and a misshapen, dumbbell shaped gate hole 58. The gate hole 58 is referred to as a "double" and is of a shape that an emitter, such as the emitter 34 of FIG. 1 (PRIOR ART) cannot be formed.

Figure 6A:
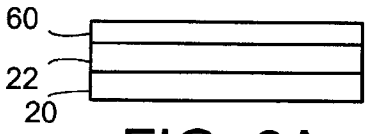
FIGS. 6A & 6B are a cross-sectional side view and a top view of a gate after deposition of a soft mask layer.
Figure 6B:
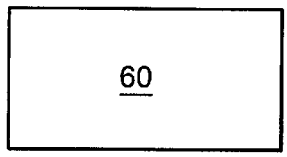

Referring now to FIGS. 6A & 6B, therein are shown a cross-sectional side view and a top view of the insulator 20 and the conductive gate electrode 22 with a soft mask material 60 deposited on the conductive gate electrode 22. The soft mask material 60 may be of a number of different materials, such as a silicon nitride (SiN). The same numbers are used here to designate the same elements as in the PRIOR ART. Generally there is a cleaning step before deposition of the soft mask material 60 to assure good contact between the soft mask material 60 and the gate electrode 22.

Figure 7A:
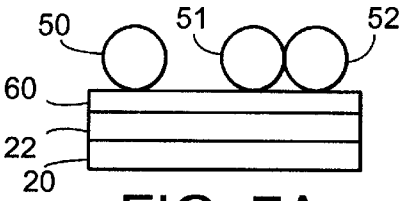
FIGS. 7A & 7B are a cross-sectional side view and a top view after deposition of micro spheres.
Figure 7B:
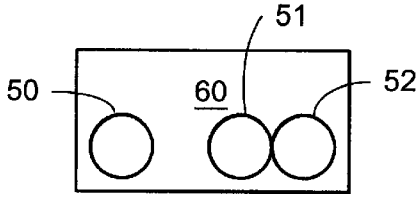

Referring now to FIGS. 7A & 7B, therein are shown a cross-sectional side view and a top view of the respective structures of FIGS. 6A & 6B with microspheres 50–52 deposited on the soft mask material 60. Again, the microspheres 51 and 52 are in contact.

Figure 8A:
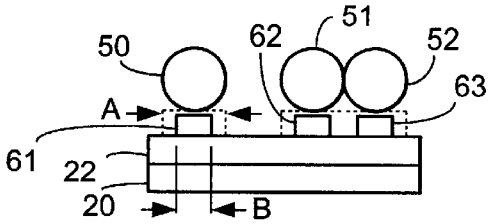
FIGS. 8A & 8B are a cross-sectional side view and a top view after etching of the soft mask and removal of the microspheres.
Figure 8B:
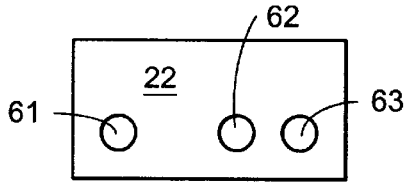

Referring now to FIGS. 8A & 8B, therein are shown a cross-sectional side view and a top view of the respective structures of FIGS. 7A & 7B after etching of the soft mask material 60 and before removal of the microspheres 50–52. During etching of the soft mask material 60, the soft mask material 60 is etched in areas away from the microspheres 50–52 and also undercuts the microspheres 50–52. For example, where the microsphere 50 has a diameter equal to A, the area A under the microsphere 50 will be etched away to have a diameter designated by the letter B. The undercutting leaves soft mask portions 61–63 of the soft mask material 60. As shown in FIG. 8B, the remaining portion soft mask material 60 is removed until a large portion of the conductive gate electrode 22 is exposed.

Figure 9A:
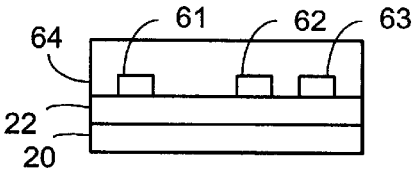
FIGS. 9A & 9B are a cross-sectional side view and a top view after coating of the hard mask.
Figure 9B:
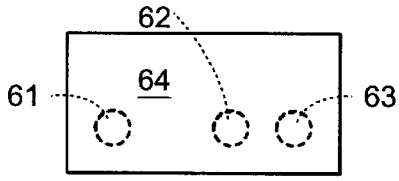

Referring now to FIGS. 9A & 9B, therein are shown a cross-sectional side view and a top view of the respective structures of FIGS. 8A & 8B after the microspheres 50–52 are removed and a deposition of a hard mask material 64. The microspheres 50–52 may be removed by megasonic cleaning or by a process, such as ashing, to burn up the microspheres 50–52 followed by a cleaning process to remove the ash. The hard mask material covers the soft mask portions 61–63. The hard mask material 64 may be of a material such as spin-on glass (SOG), which is permitted to level out and then is baked to form a hard coating over the soft mask portions 61–63 and the conductive gate electrode 22.

Figure 10A:
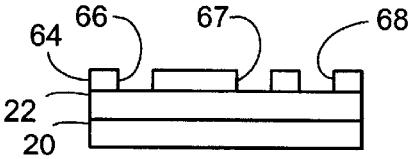
FIGS. 10A & 10B are a cross-sectional side view and a top view after chemical mechanical polishing of the coating.
Figure 10B:
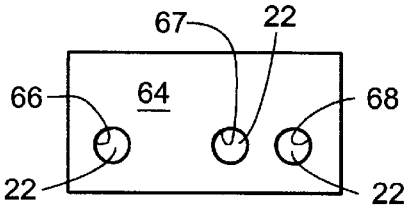

Referring now to FIGS. 10A & 10B, therein are shown a cross-sectional side view and a top view of the respective structures of FIGS. 9A & 9B after chemical mechanical polishing (CMP) to remove the hard mask material 64 until the soft mask portions 61–63 are exposed. Alternatively, an etch-back process is used with an etch having selectivity to the soft mask material 60 of the soft mask portions 61–63. FIGS. 10A & 10B also show removal of the soft mask portions 61–63 by isotropic etching to leave the hard mask material 64 with holes 66–68 which expose the conductive gate electrode 22.

Figure 11A:
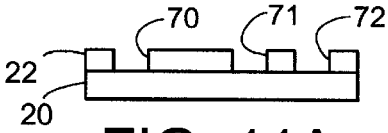
FIGS. 11A & 11B are a cross-sectional side view and a top view after hard mask etch to form the completed gate with gate holes.
Figure 11B:
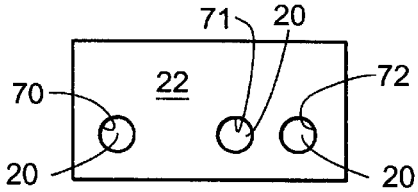

Referring now to FIGS. 11A & 11B, therein are shown a cross-sectional side view of the respective structures of FIGS. 10A & 10B after etching of the conductive gate electrode 22 using the hard mask material 64 and removal of the hard mask material 64 by an etching process having selectivity to the conductive gate electrode 22. The remaining structure has the conductive gate electrode 22 with gate openings, or gate holes 70–72, which are all properly shaped and spaced apart. Further, the process of the present invention allows the gate holes 70–72 to be smaller than the microspheres 50–52, and thus smaller than possible with the prior art processes.

While the invention has been described in conjunction with a specific best mode, it is to be understood that many alternatives, modifications, and variations will be apparent to those skilled in the art in light of the aforegoing description. Accordingly, it is intended to embrace all such alternatives, modifications, and variations that fall within the spirit and scope of the included claims. All matters set forth herein or shown in the accompanying drawings are to be interpreted in an illustrative and non-limiting sense.

The invention claimed is:

1. A method for manufacturing a structure having openings provided therein, comprising the steps of:

depositing a first mask material over the structure;

depositing uniformly-sized particles on the structure;

removing the first mask material to form first mask portions under the uniformly-sized particles;

removing the uniformly-sized particles;

depositing a second mask material over the first mask portions and structure;

removing the second mask material down to the first mask portions;

removing the first mask portions leaving openings in the second mask material;

removing portions of the structure using the openings in the second mask material to form openings in the structure whereby the openings are spaced apart; and removing the second mask material.

2. The method for manufacturing a structure as claimed in claim 1 wherein the step of depositing the first mask material uses a material selected from a group consisting of silicon nitride, silicon oxynitride, and combinations thereof.

3. The method for manufacturing a structure as claimed in claim 1 wherein the step of removing the first mask material uses an isotropic etching process.

4. The method for manufacturing a structure as claimed in claim 1 wherein the step of removing the first mask material uses a controlled isotropic etching process to control the size of the first mask portions.

5. The method for manufacturing a structure as claimed in claim 1 wherein the step of depositing the uniformly-sized particles uses microspheres of a material selected from a group consisting of silica, glass, plastics, and a combination thereof.

6. The method for manufacturing a structure as claimed in claim 1 wherein the step of removing the uniformly-sized particles uses a removal process followed by a cleaning process.

7. The method for manufacturing a structure as claimed in claim 1 wherein the step of depositing the second mask uses a material selected from a group consisting of spun on glass, silicon dioxide, and a combination thereof.

8. The method for manufacturing a structure as claimed in claim 1 wherein the step of removing the second mask material down to the first mask portions uses a chemical mechanical polishing process.

9. The method for manufacturing a structure as claimed in claim 1 wherein the step of depositing the second mask includes a step of curing the spun on glass and wherein the step of removing the second mask material down to the first mask portions uses a chemical mechanical polishing process.

10. The method for manufacturing a structure as claimed in claim 1 wherein the step of removing the second mask material uses an etching process having selectivity to the material of the structure.

11. A method for manufacturing a flat panel display comprising the steps of:

providing a baseplate;

depositing a conductive row electrode on the baseplate;

depositing an insulator over the conductive row electrode;

depositing a conductive gate electrode over the insulator;

depositing a soft mask material over the conductive gate electrode;

depositing uniformly sized spherical particles on the soft mask;

removing the soft mask material to form soft mask portions under the uniformly sized spherical particles;

removing the uniformly sized spherical particles;

depositing a hard mask material over the soft mask portions and the conductive gate electrode;

removing the hard mask material down to the soft mask portions;

removing the soft mask portions leaving holes in the hard mask material;

removing the portions of the gate electrode using the holes in the hard mask material to form gate holes in the gate electrode whereby the gate holes are spaced apart;

removing the hard mask material;

forming emitter cavities in the insulator over the conductive row electrode using the gate holes; and forming emitters in the emitter cavities on the conductive row electrode.

12. The method for manufacturing a flat panel display as claimed in claim 11 wherein the step of depositing the soft mask material uses a material selected from a group consisting of silicon nitride, silicon oxynitride, and combinations thereof.

13. The method for manufacturing a flat panel display as claimed in claim 11 wherein the step of removing the soft mask material uses an isotropic etching process.

14. The method for manufacturing a flat panel display as claimed in claim 11 wherein the step of removing the soft mask material uses a controlled isotropic etching process to control the size of the soft mask portions.

15. The method for manufacturing a flat panel display as claimed in claim 11 wherein the step of :depositing the uniformly sized spherical particles uses microspheres of a material selected from a group consisting of silica, glass, plastics, and a combination thereof.

16. The method for manufacturing a flat panel display as claimed in claim 11 wherein the step of removing the uniformly-sized spherical particles uses an removal process followed by a cleaning process.

17. The method for manufacturing a flat panel display as claimed in claim 11 wherein the step of depositing the hard mask uses a material selected from a group consisting of spun on glass, silicon dioxide, and a combination thereof.

18. The method for manufacturing a flat panel display as claimed in claim 11 wherein the step of removing the hard mask material down to the soft mask portions uses processes including chemical mechanical polishing and etch-back using an etch having selectivity to the soft mask material.

19. The method for manufacturing a flat panel display as claimed in claim 11 wherein the step of depositing the hard mask includes a step of curing the spun on glass and wherein the step of removing the hard mask material down to the soft mask portions uses a chemical mechanical polishing process.

20. The method for manufacturing a flat panel display as claimed in claim 11 wherein the step of removing the hard mask material uses an etching process having selectivity to the material of the conductive gate electrode.

* * * * *